US007565987B2

(12) United States Patent
Bauer

(10) Patent No.: US 7,565,987 B2
(45) Date of Patent: Jul. 28, 2009

(54) PULL TAB ACTIVATED SEALED PACKET

(75) Inventor: Walter G. Bauer, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 490 days.

(21) Appl. No.: 11/217,110

(22) Filed: Aug. 31, 2005

(65) Prior Publication Data

US 2007/0045341 A1 Mar. 1, 2007

(51) Int. Cl.
*B65D 47/10* (2006.01)

(52) U.S. Cl. ..... 222/107; 222/541.9; 206/438; 206/484.2; 383/210

(58) Field of Classification Search ..... 222/107, 222/153.06, 153.07, 541.1, 541.3, 541.6, 222/541.9; 206/348, 438, 484–484.2; 383/66, 383/68, 210–211
See application file for complete search history.

(56) References Cited

U.S. PATENT DOCUMENTS 506,982 A * 10/1893 Diamond ..... 222/541.1
1,069,044 A * 7/1913 Traub ..... 24/27
1,123,010 A * 12/1914 Richardson ..... 383/122
2,331,842 A * 10/1943 Moran ..... 222/633
2,390,822 A * 12/1945 Wren ..... 222/572
2,446,308 A * 8/1948 Smith ..... 229/117.34
2,980,940 A 4/1961 Crowe
3,053,385 A * 9/1962 Spees ..... 206/361
3,256,941 A * 6/1966 Rivman ..... 383/86
3,268,184 A * 8/1966 Biggar et al. ..... 244/158.3
3,299,464 A * 1/1967 O'Brien et al. ..... 15/104.94
3,338,992 A 8/1967 Kinney
3,341,394 A 9/1967 Kinney
3,386,793 A * 6/1968 Stanton ..... 401/132
3,419,136 A * 12/1968 Pratt ..... 206/361

(Continued)

FOREIGN PATENT DOCUMENTS

DE 3335614 4/1985

(Continued)

OTHER PUBLICATIONS

International Search Report, Dec. 6, 2006.

(Continued)

*Primary Examiner*—Kevin P Shaver
*Assistant Examiner*—Andrew P Bainbridge
(74) *Attorney, Agent, or Firm*—Dority & Manning, P.A.

(57) ABSTRACT

A pull activated packet for storing and dispensing any manner of fluid composition includes opposed first and second material layers defining a sealed cavity between the opposed layers. The fluid composition is contained within the cavity. Exit structure is defined in the first material layer through which the composition exits the cavity in use of the packet. A flap is defined by a portion of the opposed layers and is folded at a first fold line so as to extend over and releasably seal to the first material layer over the exit structure. To open the packet, the flap or an extension of the flap is pulled by the user causing the flap to peel away from the first material layer and unseal from over the exit structure. The fluid composition is dispensed from the exit structure upon pressure being applied to the packet.

12 Claims, 4 Drawing Sheets

U.S. PATENT DOCUMENTS 3,462,070 A * 8/1969 Corella ..... 206/219
3,481,676 A * 12/1969 Schwartzman ..... 401/134
3,485,562 A * 12/1969 Cairns et al. ..... 401/134
3,494,821 A 2/1970 Evans
3,502,538 A 3/1970 Petersen
3,502,763 A 3/1970 Hartmann
3,542,615 A 11/1970 Dobo et al.
3,567,074 A * 3/1971 Brown ..... 222/107
3,618,756 A 11/1971 Trewella
3,640,877 A 2/1972 Gobert
3,692,618 A 9/1972 Dorschner et al.
3,706,410 A * 12/1972 Baker ..... 206/438
3,722,174 A 3/1973 Bergevin et al.
3,768,916 A 10/1973 Avery
3,802,817 A 4/1974 Matsuki et al.
3,849,241 A 11/1974 Butin et al.
3,855,046 A 12/1974 Hansen et al.
3,856,142 A * 12/1974 Vessalo ..... 206/530
3,917,116 A * 11/1975 Mason ..... 222/92
3,998,559 A 12/1976 Hoyt
4,027,985 A 6/1977 Loesser, III
4,084,910 A 4/1978 LaRosa
4,100,324 A 7/1978 Anderson et al.
4,144,370 A 3/1979 Boulton
4,148,318 A 4/1979 Meyer
4,291,697 A 9/1981 Georgevich
4,318,506 A * 3/1982 Hirsch ..... 383/89
4,318,818 A 3/1982 Letton et al.
4,330,220 A 5/1982 Schaar et al.
4,340,563 A 7/1982 Appel et al.
4,367,842 A * 1/1983 Rausing ..... 383/66
4,415,288 A 11/1983 Gordon et al.
4,430,013 A 2/1984 Kaufman
4,469,463 A 9/1984 Van Overloop
4,470,153 A * 9/1984 Kenan ..... 383/101
4,475,835 A 10/1984 Verboom et al.
4,478,530 A 10/1984 Van Overloop
4,525,091 A 6/1985 Van Overloop
4,526,773 A 7/1985 Weber
4,545,180 A 10/1985 Chung et al.
4,563,103 A 1/1986 Van Overloop et al.
4,576,316 A * 3/1986 Foster ..... 222/541.6
4,576,817 A 3/1986 Montgomery et al.
4,578,265 A 3/1986 Pellico et al.
4,629,080 A * 12/1986 Carveth ..... 215/11.1
4,638,913 A 1/1987 Howe, Jr.
4,657,802 A 4/1987 Morman
4,659,609 A 4/1987 Lamers et al.
D290,292 S 6/1987 Gatarz
4,784,506 A 11/1988 Koreska et al.
4,786,190 A * 11/1988 Van Erden et al. ..... 383/203
4,795,270 A * 1/1989 Heyden ..... 383/77
4,805,767 A 2/1989 Newman
4,818,464 A 4/1989 Lau
4,828,556 A 5/1989 Braun et al.
4,830,205 A * 5/1989 Hammond et al. ..... 215/11.3
4,833,003 A 5/1989 Win et al.
4,885,155 A 12/1989 Parran, Jr. et al.
4,948,427 A 8/1990 Yamagishi et al.
4,959,881 A 10/1990 Murray
4,978,232 A 12/1990 Dunton
5,048,589 A 9/1991 Cook et al.
5,059,035 A 10/1991 Kristensen
5,090,832 A 2/1992 Rivera et al.
5,094,559 A 3/1992 Rivera et al.
5,132,151 A * 7/1992 Graney ..... 428/41.3
5,270,337 A 12/1993 Graf
5,273,514 A 12/1993 Kristensen
5,284,703 A 2/1994 Everhart et al.
5,284,871 A 2/1994 Graf
5,348,943 A 9/1994 Pickart
5,350,624 A 9/1994 Georger et al.
5,382,400 A 1/1995 Pike et al.
5,399,412 A 3/1995 Sudall et al.
5,510,001 A 4/1996 Hermans et al.
5,591,309 A 1/1997 Rugowski et al.
5,591,510 A 1/1997 Junker et al.
5,620,779 A 4/1997 Levy et al.
5,637,194 A 6/1997 Ampulski et al.
5,654,164 A 8/1997 Gardiol et al.
5,695,868 A 12/1997 McCormack
D390,708 S 2/1998 Brown
5,772,845 A 6/1998 Farrington, Jr. et al.
5,791,801 A 8/1998 Miller
5,792,213 A 8/1998 Bowen
5,804,401 A 9/1998 Gardiol et al.
5,843,056 A 12/1998 Good et al.
5,891,422 A 4/1999 Pan et al.
5,911,915 A 6/1999 Fonsny et al.
5,916,862 A 6/1999 Morelli et al.
5,942,482 A 8/1999 Zocchi et al.
5,962,112 A 10/1999 Haynes et al.
5,994,283 A 11/1999 Durbut et al.
6,017,417 A 1/2000 Wendt et al.
D428,267 S 7/2000 Romano, III et al.
6,093,665 A 7/2000 Sayovitz et al.
6,112,752 A * 9/2000 Tahara ..... 132/293
6,147,039 A 11/2000 Jacques et al.
6,156,421 A 12/2000 Stopper et al.
6,197,404 B1 3/2001 Varona
6,200,941 B1 3/2001 Strandburg et al.
6,215,038 B1 4/2001 Davis et al.
6,244,468 B1 * 6/2001 Farmer et al. ..... 222/107
6,248,125 B1 6/2001 Helming
6,303,046 B1 10/2001 Risen, Jr. et al.
6,303,557 B1 10/2001 Colclough
6,315,864 B2 11/2001 Anderson et al.
6,409,770 B1 6/2002 Weiss et al.
6,432,270 B1 8/2002 Liu et al.
6,508,602 B1 1/2003 Gruenbacher et al.
6,588,961 B2 7/2003 Lafosse-Marin et al.
6,662,829 B2 * 12/2003 Credle, Jr. ..... 141/10
6,732,943 B2 * 5/2004 Srinivasan ..... 239/1
6,783,030 B2 * 8/2004 Redmond ..... 222/107
6,811,057 B2 * 11/2004 Duquet et al. ..... 222/105
6,883,683 B1 * 4/2005 Cunningham et al. ..... 222/107
6,971,550 B2 * 12/2005 Kuge et al. ..... 222/105
2001/0030192 A1 * 10/2001 Redmond ..... 220/203.08
2003/0135181 A1 7/2003 Chen et al.
2004/0053803 A1 3/2004 Lye et al.
2005/0077324 A1 * 4/2005 Redmond ..... 222/541.9

FOREIGN PATENT DOCUMENTS

EP 0074161 A2 3/1983
EP 0307376 3/1989
EP 0369678 5/1990
EP 0517566 B1 12/1992
EP 0442292 B1 3/1994
EP 0603931 6/1994
EP 0675703 B1 5/1998
EP 0841049 A1 5/1998
EP 1046591 A2 10/2000
GB 1225713 3/1971
JP 55017571 2/1980
JP 56030869 3/1981
JP 58191167 11/1983
JP 60021255 2/1985
JP 62049932 3/1987
JP 63147652 6/1988
JP 02290201 11/1990
JP 4147863 5/1992
JP 5017712 1/1993
JP 5320549 12/1993

| | | | |
|---|---|---|---|
| JP | 7097597 | | 4/1995 |
| JP | 9031378 | | 2/1997 |
| JP | 10060339 | | 3/1998 |
| JP | 10202910 | | 8/1998 |
| WO | WO 9111105 | | 8/1991 |
| WO | WO 9638548 | | 12/1996 |
| WO | WO 9707729 | | 3/1997 |
| WO | 9903391 | | 1/1999 |
| WO | WO 9928411 | | 6/1999 |
| WO | WO 0078861 | A1 | 12/2000 |
| WO | WO 03106333 | | 12/2003 |

OTHER PUBLICATIONS

Co-pending U.S. Appl. No. 10/844,568, filed Apr. 30, 2004.
www.drugstore.com/templates/brand/default.asp?brand=7840, Sep. 4, 2002.
Co-pending U.S. Appl. No. 11/215,816, filed Aug. 30, 2005.
Co-pending U.S. Appl. No. 11/217,079, filed Aug. 31, 2005.

* cited by examiner

PULL TAB ACTIVATED SEALED PACKET

BACKGROUND

Sealed disposable pouches or packets for storing and dispensing fluid compositions are well known in the art. Examples include food product packets, such as condiment packets, and medical products packets, such as lotion or ointment packets. Many types of these conventional packets are designed to be torn or separated along a defined location on the packet. However, this action requires a relatively high degree of manual dexterity and can be difficult for children and the elderly. Also, the tearing action often results in a sudden and uncontrolled release of the packet contents. Other packets are designed to burst along a frangible seam or portion when pressure is applied to the packet. Such devices are, however, not selective and burst under sufficient pressure, regardless of whether that pressure is applied intentionally by a user, or is applied unintentionally during handling, shipping, or storage.

It is also known to use packets or pouches within other structures for various purposes. For example, U.S. Pat. No. 6,508,602 describes an applicator intended to distribute a fluid from an enclosed reservoir when pressure is applied to the applicator causing the reservoir to rupture. To prevent the reservoir from bursting prematurely, the '602 patent proposes to fold the entire applicator such that the reservoir within the applicator is also folded along an axis that isolates the rupturable portion of the reservoir. To use the applicator, a consumer must unfold the device prior to inserting their hand into the applicator to apply sufficient pressure for bursting the reservoir. This configuration requires additional folding steps and packaging considerations, such as additional restraining structure or packaging materials to ensure that the applicator remains folded prior to use. This is not a desirable situation from a manufacturing and packaging standpoint.

The art is thus continually seeking improved packet or reservoir designs that are reliable and yet easy to open and use by consumers.

SUMMARY

Objects and advantages of the invention will be set forth below in the following description, or may be obvious from the description, or may be learned through practice of the invention.

The present invention proposes a novel packet design for storing and dispensing any manner of fluid composition. The packet is easy to manufacture, maintains structural integrity during storage, will not burst during normal handling, and is relatively simple to open and use. The packet is not limited by its intended use or type of fluid composition contained within the packet. For example, the packet may contain any manner of medical lotion, ointment, salve, or other medical fluid composition. In other embodiments, the fluid composition may be a cleaning or polishing agent. The packet according to the invention may have particular usefulness in the food service industry as a condiment packet. It should thus be appreciated that the novel packet according to the invention may have utility in any number of fields, and all such uses are within the scope and spirit of the invention.

The packet may be defined by opposed first and second material layers sealed along a perimeter seal to define a sealed cavity. Exit structure is defined through the first material layer, and may be one or more openings, such as a series of holes or slits in the material layer, or a weakened portion of the packet material created by embossing, laser scoring, mechanical scoring, other known methods for weakening a film structure. The exit structure communicates with the internal cavity of the packet in which the fluid composition is contained.

Baffle structure, or other restricting structure, may be provided in the cavity to aid in controlling the flow rate of the fluid composition out of the packet. The baffle structure may be defined by one or more seals between the opposed material layers of the packet that define a restrictive flow path for the fluid composition.

A flap is defined by a portion of the opposed packet material layers folded at a first fold line so as to extend over and releasably seal to the first material over the exit structure. In its folded and sealed configuration, the flap may be grasped directly by the user, or a flap extension may be provided having a shape and configuration to be readily grasped by the user. While holding the packet, the user simply pulls the flap, or flap extension, in a direction that causes the flap to peel away from the first material layer and unseal from over the exit structure. The fluid composition is then delivered out of the packet through the exit structure upon pressure being applied to the packet by the user.

In a particular embodiment, a seal line between the opposed material layers of the packet may be provided between the flap and the cavity, with the flap folded over at this seal line so as to extend over the exit structure and seal to the first material layer in a first pass. The flap may then be folded back in an opposite direction at a second fold line so as to extend back over the exit structure in a second pass. Although not necessary for seal integrity of the flap over the exit structure, the flap may be releasably sealed to the second material layer adjacent the second fold line so that the flap is held in a compact and tight configuration against the packet prior to use.

The packet material layers can vary. In certain embodiments, laminated metallized films may be desired depending on the nature of the fluid composition within the packet. In a particular embodiment, the opposed material layers of the packet include heat sealable thermoplastic materials, such as thermoplastic film layers, heat-sealed together along a perimeter seal using conventional heat seal techniques. The flap may be heat sealed directly to the first material layer in a seal zone that circumscribes the exit structure. The seal zone may be a border around the exit structure, or a continuous seal zone that encompasses the exit structure. In this embodiment, the first material layer may have an outer surface or layer with heat seal characteristics different from those of an inner surface of the material. In this way, the flap may be heat-sealed against the first material layer at heat seal conditions (i.e., temperature, dwell time, and pressure) different from those needed to heat seal the opposed material layers together along the perimeter seal. The flap seal may thus be considered weaker or "frangible" as compared to the perm perimeter seal defining the cavity, or other pouch structure. The first material layer may be, for example, a multi-layered film with different layers having different melt points. The layers may be co-extruded or laminated layers, with one of the outer surface layers including a sealant material or coating, such as Surlyn® from Dupont, or a blend of polybutylene with ethylene vinyl acetate or ultra low density ethylene copolymers, polyolefin plastomers, or polyethylene. Sealant layers made with these resins or blends may provide seals of varying seal strength as compared to the base polymer depending upon seal temperature, dwell time, and pressure. Thus, the seal between the flap and outer surface of the first material layer can be made selectively frangible as compared to the permanent perimeter seal defining the packet cavity by varying the sealing conditions.

The second material layer may be the same or a different thermoplastic film as compared to the first material layer.

In still another embodiment, the flap is folded at a second fold line disposed such that the exit structure (with sealed flap) is folded in a direction so as to lie adjacent to the second material layer. In this configuration, the exit structure is isolated from the contents of the cavity by the second fold line. The flap is releasably sealed to the second material layer adjacent to the second fold line. In this embodiment, the opposed material layers may be thermoplastic materials heat-sealed together along a perimeter seal defining the cavity. The flap is heat sealed directly to the first material layer over the exit structure in a seal zone that circumscribes the exit structure, and is heat-sealed directly to the second material layer adjacent the second fold line. The first and second material layers may be multi-layer films having an outer sealant layer as discussed above with heat seal characteristics such that the flap is heat sealed against the first and second material layers in a frangible releasable seal as compared to the perimeter seal defining the cavity.

With yet another embodiment, the packet may be defined by a combination of opposed material layers heat sealed together along a perimeter seal defining the cavity, with the flap heat sealed directly to the first material layer over the exit structure in a seal zone that circumscribes the exit structure. The flap seal is formed at a temperature, dwell time, and pressure so as to be frangible as compared to the perimeter seal. In order to prevent the opposed layers from sealing to each other in the flap seal zone when heat sealing the flap to the first material layer, an insert device may be disposed within the cavity at a location relative to the seal zone to prevent the material layers from sealing together within the cavity. The insert may be any material that will not seal to both of the opposed material layers upon heat-sealing the flap to the first material layer. In a particular embodiment, the insert may be a strip of thermoplastic material having at least one surface that will not heat seal to the opposed material layers. The opposite surface may have a sealant layer so that the insert material seals to the bottom material layer within the cavity. The insert thus defines a channel or conduit to ensure that the fluid composition is free to flow out of the exit structure upon the flap being peeled away from the first material layer.

Aspects of the invention will be described in greater detail below by reference to particular embodiments illustrated in the figures.

DETAILED DESCRIPTION OF THE PREFERRED EMBODIMENTS

Figure 1:
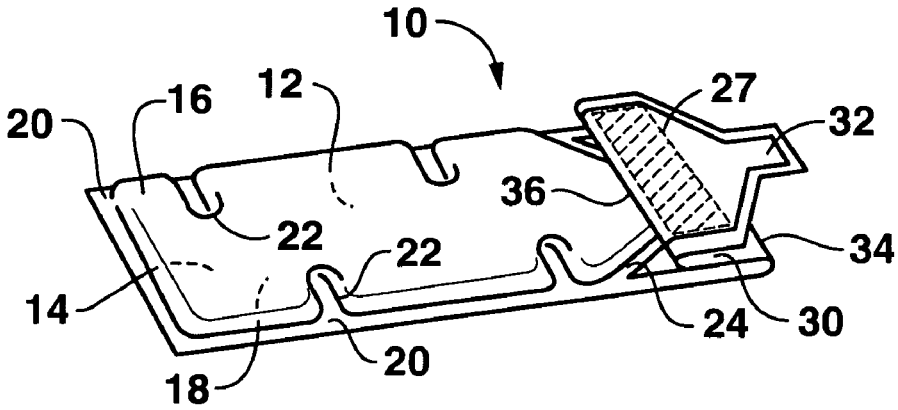
FIG. 1 is a perspective view of a packet embodiment according to the present invention.

Reference will now be made in detail to one or more embodiments of the invention, examples of which are illustrated in the drawings. The embodiments are provided by way of explanation of the invention, and are not meant as a limitation of the invention. Features illustrated or described as part of one embodiment may be used with another embodiment to yield still a different embodiment. It is thus intended that the present invention include modifications and variations to the embodiments illustrated and described herein.

It should be appreciated that the novel packet according to the invention is not limited to any particular intended use or type of fluid composition stored in the packet.

Referring to the figures in general, various embodiments of a packet 10 are illustrated. In the embodiment of FIG. 1, the packet 10 is depicted as a relatively small, disposable structure designed to store and dispense any desired fluid composition 14. The packet 10 may be any size depending on dose of the fluid composition 14 desired to be deliver with use of the packet 10. As discussed in greater detail below, the packet 10 is sealed by a folded flap 30, and the packet is opened by the user pulling on the flap 30, or a flap extension 32, which causes the flap 30 to unfold and expose exit structure 28 in the packet through which the fluid composition 14 migrates.

As seen in the various figures, the packet 10 defines a cavity 12 in a first portion of the packet, with the fluid composition 14 contained within the cavity 12. The packet 10 may be formed from opposed material layers 16, 18 attached together to define the sealed cavity 12. The opposed layers 16, 18 may attached by thermal bonding, although any suitable attachment method may be used depending on the type of material selected for the layers 16, 18.

The packet material layers 16, 18 may be made from any suitable flexible material that is impermeable to the fluid composition 14 contained in the cavity 12. The packet materials should have no negative impact on or reaction with the fluid 14. The materials used in the construction of the packet 10 and the fill level of the fluid composition 14 within the cavity 12 create a structure that is durable and flexible, and one that is not easily burst open during normal handling. The packet 10 may be formed from the material layers 16, 18 using any conventional attaching techniques, such as adhesives, stitching, welding, heat-sealing, ultrasonic, and so forth. In particular embodiments, the material layers 16, 18 are a heat sealable thermoplastic material, such as a polyethylene or polypropylene film, or other suitable thermoplastics. The layers may also be metallized films. It should be appreciated that the bonding or attaching techniques used to form the packet 10 and associated structure will be a function of the type of materials selected for layers 16, 18.

The packet 10 may include one or more bond points or seals between the opposed layers to define the cavity 12, or other features of the packet. For example, referring to FIGS. 1 and 2A, the packet 10 includes seal lines 20 that define a perimeter seal and baffles 22 within the cavity 12, the baffles 22 serving to control flow rate of the fluid composition 14 from the cavity 12. Additional bond lines 24 define a nozzle structure 26 oriented towards the exit structure 28.

Exit structure 28 is provided in a first of the packet material layers, such as layer 16, through which the fluid composition 14 flows in use of the packet 10. Configuration of the exit structure 28 can vary. For example, the structure 28 may comprise any pattern of holes, slits, apertures, or other openings defined completely through the material layer 16. In alternate embodiments, the exit structure 40 may be weakened positions in the packet material or seam structure designed to rupture or burst upon pressure being exerted on the packet. Such weakened positions may be created by embossing, laser scoring, mechanical scoring, or other known methods for weakening a film structure.

Figure 2A:
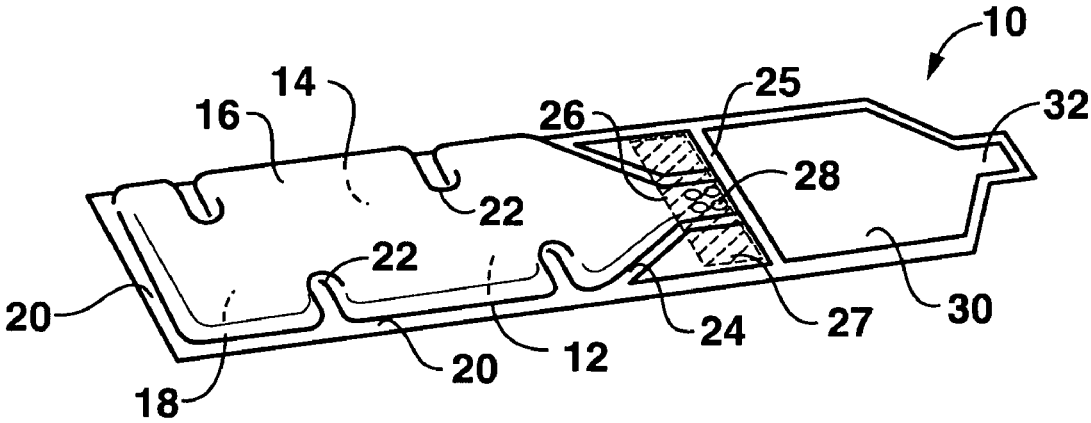
FIG. 2A is a perspective view of the packet according to FIG. 1 prior to being folded and sealed.
Figure 2B:
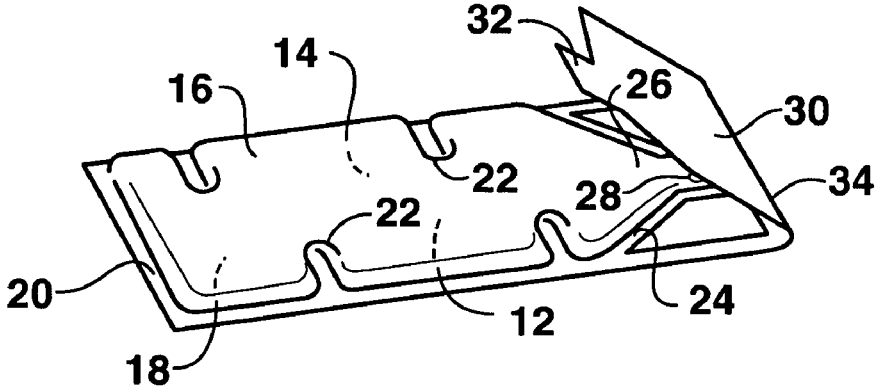
FIG. 2B is a perspective and view of the packet according to FIG. 2A with the flap in a partial folded condition.
Figure 2C:
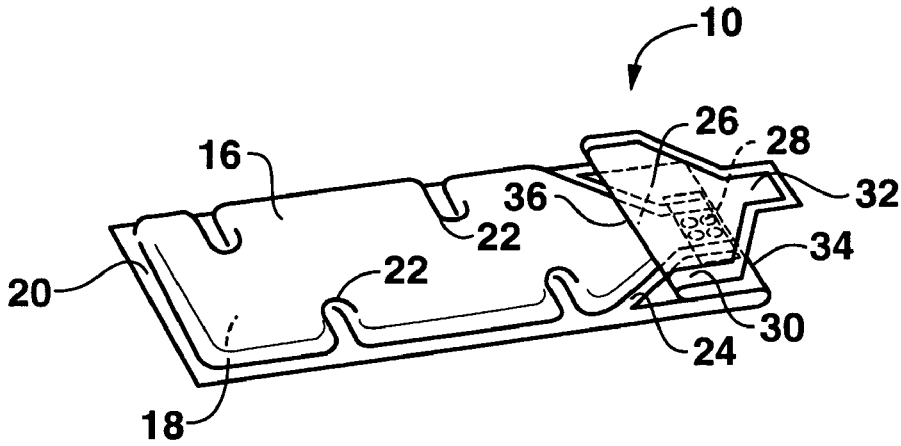
FIG. 2C is a perspective view of the packet according to FIG. 2B with the flap folded and sealed over the exit structure.

The packet 10 incorporates a flap 30 that is formed from an extension of the opposed packet material layers 16, 18 that may be sealed together in a second portion of the packet 10 that is adjacent to the first portion defining the cavity 12, as particularly illustrated in FIG. 2A. As illustrated in FIGS. 2A through 2C, the flap 30 may be folded at a first fold line 34 that corresponds to a seal line 25 (FIG. 2A) used to define a longitudinal end of the cavity 12. The flap 30 is folded so as to extend back over the cavity 12 a sufficient distance to cover and releasably seal to the first material layer 16 over the exit structure 28, as particularly seen in FIGS. 2B and 2C. The seal 38 (FIG. 3A) between the flap 30 and material layer 32 is designed to be releasable or frangible so that the flap 30 can be subsequently peeled away from the material layer 16 to expose the exit structure 28 without otherwise compromising the packet integrity. For example, a releasable adhesive may be disposed between the flap 30 and material layer 16 for this purpose.

Referring to FIG. 2C, the flap 30 may be folded at a second fold line 36 in an opposite direction so as to extend back over the exit structure 28. This additional fold may be releasably attached to the first fold at a seal 40 (FIG. 3A) adjacent the second fold line 36, although this is not a necessity.

In particular embodiments of the packet 10, the opposed material layers 16, 18 are thermoplastic materials, such as thermoplastic film layers, heat sealed together along the perimeter seal 20 to define cavity 12, and also baffles 22 and nozzle structure 26 if desired. With thermoplastic materials, the flap 30 may be heat sealed directly to the first material layer 16 over the exit structure 28 in a seal zone 27 (indicated by the dashed lines in FIG. 2A) that circumscribes the exit structure 28. The seal zone 27 may be a border seal around the exit structure 28, or a continuous seal over the area of seal zone 27 that encompasses the exit structure 28, as indicated by the dashed lines in seal zone 27 of FIGS. 1 and 2A. For example, the first material layer 16 may have an outer surface layer with heat seal characteristics (i.e. temperature, dwell time, and pressure) different than that of an inner surface layer of the material 16. In this way, the flap 30 may be heat sealed directly against the first material layer 16 at conditions different than that needed to heat seal the opposed material layers 16, 18 together along the perimeter seal. The flap seal may thus be considered weaker or "frangible" as compared to the perimeter seal defining the cavity 12, or other packet structure.

The material layer 16 may be a multi-layered film with different layers having different heat seal characteristics. The layers may be co-extruded or laminated layers, with one of the outer surface layers including a sealant material or coating, such as SURLYN from Dupont, or a blend of polybutylene with ethylene vinyl acetate or ultra low density ethylene copolymers, polyolefin plastomers, or polyethylene. Sealant layers made with these resins or blends provide different seal strengths depending upon seal temperature, dwell time, and pressure as compared to the base polymer material. Thus, the seal between the flap 30 and outer surface of the first material layer 16 can be made selectively frangible as compared to the permanent perimeter seal defining the cavity 12 by varying the sealing conditions. The flap 30 can be heat sealed directly to the material layer 16 over the exit structure 28 without concern of the inner surfaces of the material layers 16, 18 being sealed together within the seal zone 27.

The second material layer 18 may be the same or a different thermoplastic film as compared to the first material layer 16, so long as a seal can be formed with the inner surface of the material layer 16.

Various multilayer thermoplastic films are commercially available and may be used to form packets 30 as described herein. For example, a line of multilayer thermoplastic films under the name PERFECFLEX® films are available from Perfecseal, Inc. (a division of Bemis Company, Inc.) having a principal place of business in Oshkosh, Wisc., USA. A particularly suitable film from Perfecseal, Inc., is identified as EZ PEEL® Polyethylene Film (product code 34466-G). This film is a multilayered PE film having a frangible sealant layer on one outer side of a core layer. For use as material layer 16, this film is oriented so that the frangible sealant layer is outwardly facing and, thus, defines the mating surfaces of the flap 30 and material surface 16 when heat sealing the flap 30 directly to the material 16. The EZ PEEL® film (without corona treatment on the opposite outer side) may also be used as the opposite material layer 18, with the frangible sealant layer of the film outwardly disposed.

The flap 30 may be grasped directly the user to open the packet 10. In alternate embodiments, the flap 30 may include a longitudinally extending tab or extension 32 that presents an element to be grasped by the user to open the packet 10. The extension 32 may take on any desired shape or configuration. When the extension 32 is pulled, the flap 30 is caused to unfold and release from the material layer 16, and thereby uncover the exit structure 28. The fluid composition 14 within the cavity 12 is then free to migrate out of the exit structure 28 in the embodiment wherein the exit structure 28 includes holes or other openings through the packet material. In the embodiment wherein the exit structure 28 includes weakened material portions, the packet is activated by the user applying pressure to the packet (for example, by squeezing the packet) causing the weakened material portions to burst.

Figure 3A:
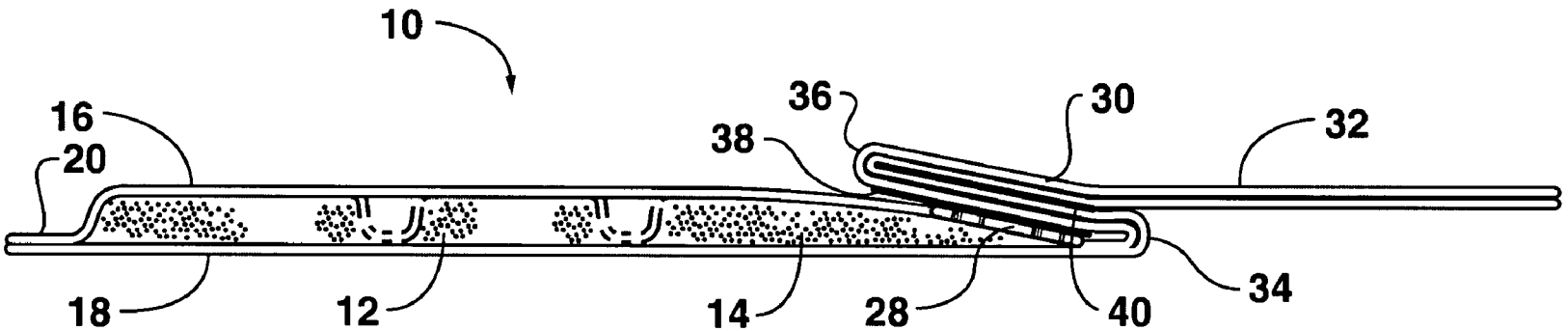
FIGS. 3A and 3B are cut-away views of a packet configuration in a folded and opened state.
Figure 3B:
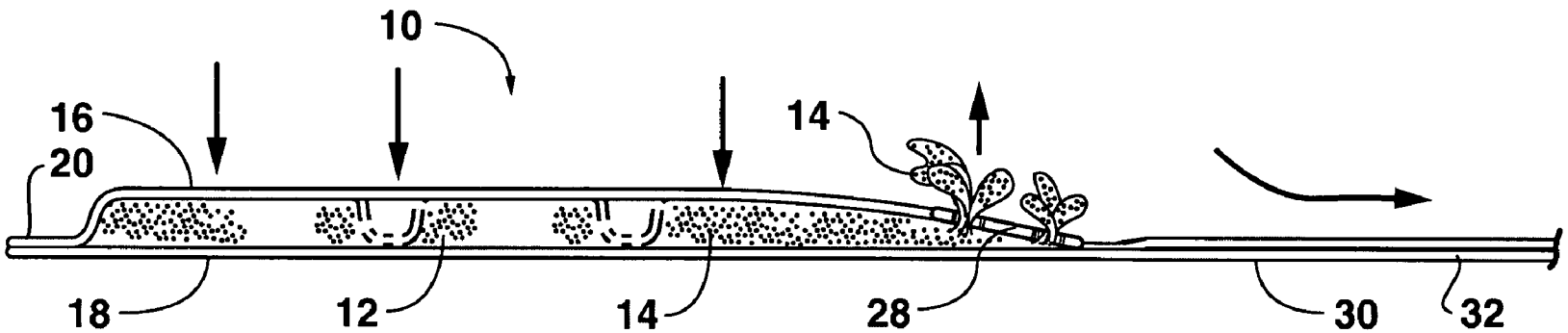

FIGS. 3A and 3B are cross-sectional views illustrating the folded and opened configuration of a particular embodiment of the packet 10. This embodiment may be made with the EZ PEEL product 34466-G as the material layers 16,18 with the frangible sealant layer outwardly facing for each material layer. Referring to FIG. 3A, seal 38 represents the heat seal between the flap 30 (folded at fold line 34) and the material layer 16 in a seal zone over the exit structure 27. Seal 40 represents an additional heat seal between folds (defined by fold line 36) of the flap 30 that may be desired to maintain the flap 30 in a compact folded state attached to the packet 10 prior to use of the device. FIG. 3B illustrates the flap 30 after flap extension 32 has been pulled by the user along the direction indicated by the arrow. This action causes the flap seal(s) 38, 40 to peel apart and thus expose the exit structure 28, at which point the fluid composition 14 can exit the cavity 12.

It should be appreciated that the seals 38 and 40 may be provided by an adhesive composition disposed between the mating surfaces, particularly in embodiments wherein non-thermoplastic materials are used as packet layers 16, 18, or bonding techniques other than heat sealing are used to construct the packets 10.

Figure 4A:
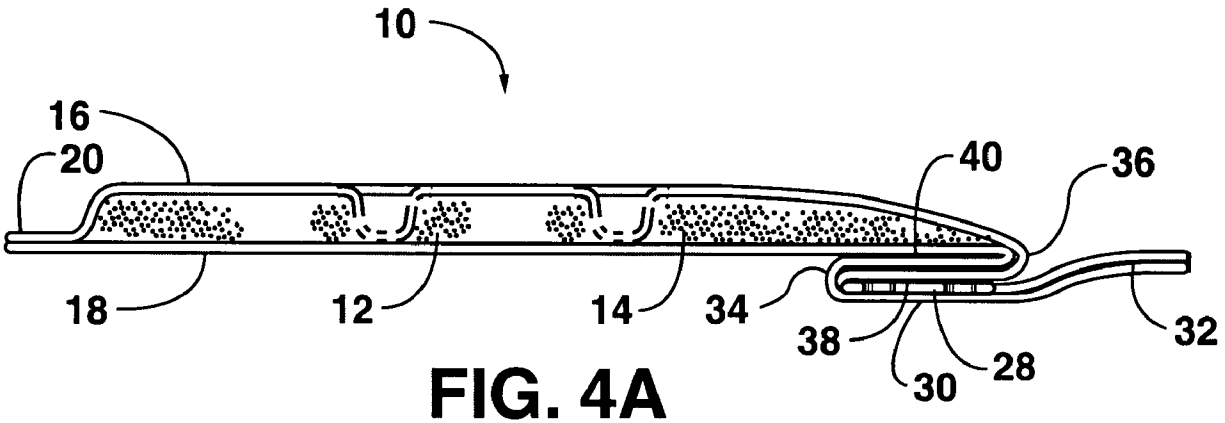
FIGS. 4A and 4B are cut-away views of an alternate packet configuration in a folded and opened state.
Figure 4B:
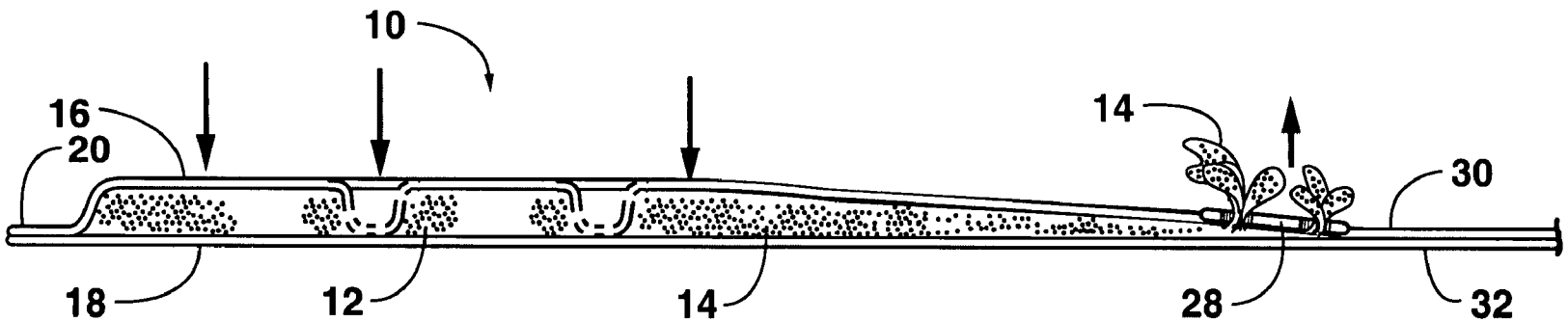

FIGS. 4A and 4B illustrate an embodiment wherein the flap 30 is folded at a second fold line 36 disposed such that the exit structure 28 (with a first fold of flap 30 sealed thereto at seal 38) is folded in an opposite direction so as to lie adjacent to the second material layer 18. This additional fold may be attached to the material layer 18 with a second seal 40. In this configuration, the exit structure 28 is isolated from the contents of the cavity by the second fold line 36. In this embodiment, the opposed material layers 16, 18 may be thermoplastic materials heat-sealed together along a perimeter seal defining the cavity 12. The flap 30 is heat sealed directly to the first material layer 16 over the exit structure 28 (as indicated at seal 38) in a seal zone that circumscribes the exit structure 28. The additional fold of the flap 30 is heat sealed directly to the second material layer 18 adjacent the second fold line 36, as indicated by seal 40. The first and second material layers 16, 18 may be multi-layer films having an outer surface with heat seal characteristics such that the flap heat seals 38, 40 are made to be frangible without sealing the inner surfaces of the material layers 16, 18 together.

Figure 5:
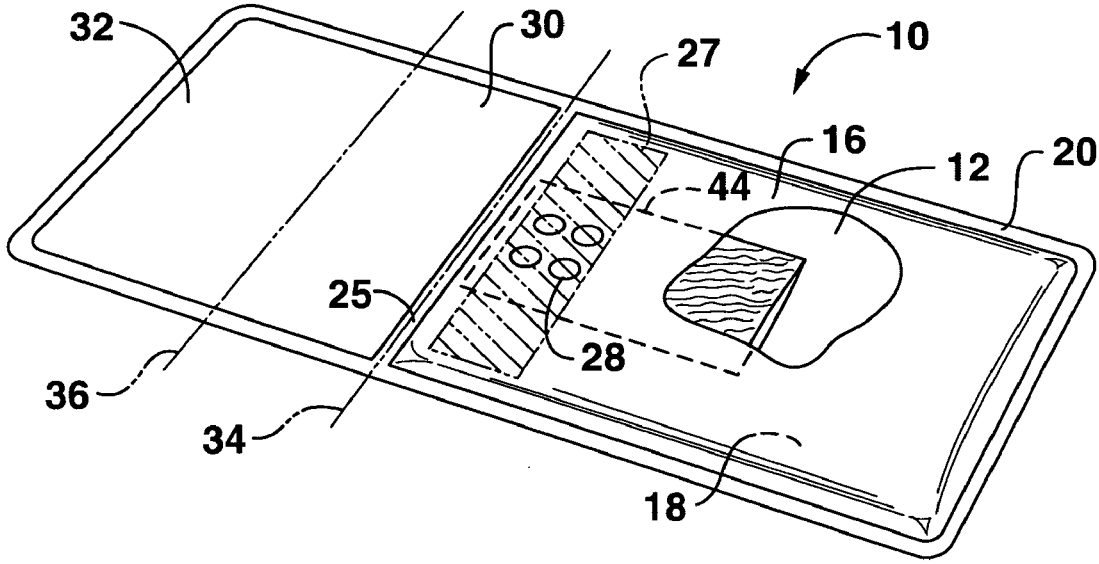
FIG. 5 is a perspective and partial cut-away view of an alternative packet configuration in accordance with aspects of the invention.

It should be appreciated that any embodiment of a packet 10 according to the invention may be made from various combinations of single and multi-layer films selected to have desired heat seal characteristics for defining the perimeter seal of the cavity 12, as well as any baffle seals 22 or nozzle seal 24, and the flap seal 38 (and seal 40 if included). With certain combinations of films, care must be taken to prevent the material layers 16, 18 from sealing together and collapsing the cavity 12 at the exit structure 28 when forming the seal 38. In this regard, FIG. 5 illustrates an embodiment wherein material layers 16, 18 may include inner film layers that could seal together at or near the exit structure 28 when forming the flap seal 38. To prevent this situation, an insert material 44 is placed within the cavity 12 prior to sealing the ends of the cavity 12. The insert 44 is positioned so as to underlie the exit structure 28 within the seal zone 27. The insert 44 is made of a material that will not seal with at least the upper material layer 16 when the seal 38 is formed between the flap 30 and material layer 16. The insert 44 may be, for example, a flexible piece of poly material having a higher melt point than material layer 16. The insert 44 thus ensures that the cavity 12 is not collapsed and sealed around the exit structure 28 when forming the flap seal 30. The insert 44 may be a multi-layered film such as a polyester/sealant layer film having a surface adjacent material layer 16 that will not heat seal with layer 16, and an opposite sealant layer surface that will heat seal with material layer 18 within the cavity, thus ensuring that the insert 44 is held in place during the sealing process. It should be appreciated that any type of material or structure may serve as insert 44.

In the embodiment of FIG. 5, the flap extension 32 is simply an extension of the entire flap 30.

The fluid composition 14 contained within the packet 30 may be any fluid suitable for the intended use of the applicator 10, including cleansing fluids for human/animal use and cleaning fluids for cleaning surfaces. The fluid may be any paste, gel, powder, oil, liquid, or any other appropriate medium. Example cleansing fluids include surfactants such as water-soluble polymers, polysorbates, glycerins, glycol-based surfactants, and/or silicone-based surfactants. The fluid may include other materials, such as water, salts, vinegars, humectants, scouring powders, thickening agents, and fragrances. A cleansing fluid may also include a moisturizer that helps to maintain a normal skin hydration level. A cleansing fluid may also include preservatives and other ingredients that do not disrupt the normal flora of the vaginal area (e.g., sorbic acid, citric acid, methyl paraben, and natural preservatives such as grapefruit extract). The fluid may include other materials that may be applied to an area of the body. Example materials include lubricants, deodorants, and other inactive or active ingredients (e.g., spermicidal agent or medication). In one aspect of the present invention, the fluid is a cleansing fluid that is primarily a water-based solution (90%+water content) with a surfactant, preservatives, pH neutralizers, and a thickening agent.

The fluid may be a cleaning solution such as FOUR PAWS Super Strength Stain and Odor Remover, which includes water, natural enzymes, and mild detergent (from Four Paws Products, Ltd., Hauppauge, N.Y.), or NATURE'S MIRACLE Stain & Odor Remover, which includes water, natural enzymes, isopropyl alcohol, and natural citrus scent (from Pets 'N People, Inc., Rolling Hills Estates, Calif.), or RESOLVE Carpet Spot & Stain Carpet Cleaner (from Reckitt Benckiser, Wayne, N.J.). The fluid may be a pet shampoo. The fluid may be a stain cleaner and stain guard such as SCOTCHGARD Oxy Carpet Cleaner with Stain Protector that includes water, 2-butoxyethanol, hydrogen peroxide, and surfactants (from 3M Corporation, St. Paul, Minn.). In the case of using the cleaning device 10 to clean a fabric surface, the fluid may include a pet repellant such as SIMPLE SOLUTION Indoor/Outdoor Repellent for Dogs and Cats, which has as an active ingredient methyl nonyl ketone (from The Bramton Company, Dallas, Tex.).

The fluid may be an antimicrobial. Examples of suitable antimicrobials include quaternary ammonium compounds such as 3-trimethoxysilylpropyldimethyloctadecyl ammonium chloride (AEGIS); poly cationic chemicals such as biguanides(poly(hexamethylene)biguanide hydrochloride (PHMB) Arch Chemical), 2,4,4'-Trichloro-2'-hydroxyl-dipenylether (Tinosan, Ciba); diphenyl ether (bis-phenyl) derivatives known as either 2,4,4'-trichloro-2' hydroxy dipenyl ether or 5-chloro-2-(2,4-dichlorophenoxyl)phenol; triclosan; silver; and copper. The fluid may be an allergen sequestrate that may be a charged or mixed charged particle or nanoparticle. Most allergy proteins are glycoproteins (proteins that contain covalently-bound oligosaccharides), so a negative charge may be better then predominance of positive charges on the particles, although mixed charges may be preferred. Clays or modified clays work in this respect. Examples of suitable allergen sequestrates include plant lectins with an affinity for N-acetylgalactosamine such as jacalin, peanut, and soybean, where the lectins both bind allergens and are bound to the web, thus removing allergens from a surface. The fluid may also include a fragrance. The fluid may also include a pheromone to either attract or repel an animal. The fluid may also be shoe polish, a carpet cleaning solution, a stain removal fluid, kitchen floor and counter top cleaners, etc.

Embodiments of the invention have been described with reference to various specific and illustrative aspects and techniques. However, it should be understood that many variations and modifications may be made while remaining within the spirit and scope. Accordingly, this is intended to embrace all such alternatives, modifications and variations that fall within the spirit and scope of the appended claims.

What is claimed is:

1. A pull activated packet for storing and dispensing any manner of fluid composition, opposed first and second material layers sealed together along a perimeter defining a sealed cavity between said opposed layers, and a fluid composition contained within said cavity;

exit structure defined in said first material layer through which said composition exits said cavity in use of said packet;

a flap defined by a portion of said opposed layers folded at a first fold line so as to extend over and releasably seal to said first material layer over said exit structure, said first fold line defined along a portion of said sealed perimeter that delimits said cavity such that said composition is not contained in said flap;

wherein to open said packet, said flap is pulled by a user causing said flap to peel away from said first material layer and unseal from said exit structure, whereby said fluid composition is dispensed from said exit structure upon pressure being applied to said packet; and wherein said flap is folded at a second fold line disposed such that said exit structure is folded adjacent said second material layer and is isolated from said cavity by said second fold line.

2. The packet as in claim 1, wherein said flap is releasably sealed to said second material layer adjacent said second fold line.

3. The packet as in claim 2, wherein said opposed material layers comprise thermoplastic materials heat sealed together along a perimeter seal defining said cavity, said flap heat sealed directly to said first material layer over said exit structure in a seal zone that circumscribes said exit structure, and said flap heat sealed directly to said second material layer adjacent said second fold line.

4. The packet as in claim 3, wherein said first and second material layers comprise an outer surface with characteristics different than an inner surface of said first and second material layers such that said flap heat seals against said first and second material layers in a frangible heat seal as compared to said perimeter seal.

5. The packet as in claim 4, wherein said first and second material layers comprise multi-layered films having an outer sealant layer with characteristics suitable for forming said frangible heat seals with said flap.

6. A pull activated packet for storing and dispensing any manner of fluid composition, opposed first and second material layers sealed together along a perimeter defining a sealed cavity between said opposed layers, and a fluid composition contained within said cavity;

exit structure defined in said first material layer through which said composition exits said cavity in use of said packet;

a flap defined by a portion of said opposed layers folded at a first fold line so as to extend over and releasably seal to said first material layer over said exit structure, said first fold line defined along a portion of said sealed perimeter that delimits said cavity such that said composition is not contained in said flap;

wherein to open said packet, said flap is pulled by a user causing said flap to peel away from said first material layer and unseal from said exit structure, whereby said fluid composition is dispensed from said exit structure upon pressure being applied to said packet; and wherein said first and second opposed material layers comprise thermoplastic materials heat sealed together along a perimeter seal defining said cavity, said flap heat sealed directly to said first material layer over said exit structure in a seal zone that circumscribes said exit structure, and further comprising an insert within said cavity disposed to prevent said first and second material layers from sealing together in said seal zone upon heat sealing said flap to said first material layer.

7. The packet as in claim 1, further comprising baffles within said packet cavity.

8. The packet as in claim 7, wherein said baffles comprise seal lines between said opposed first and second material layers of said packet.

9. The packet as in claim 1, wherein said fluid composition comprises a medicinal product.

10. The packet as in claim 1, wherein said fluid composition comprises a food product.

11. The packet as in claim 1, wherein said fluid composition comprises a cleaning product.

12. The packet as in claim 1, wherein said flap further comprises a flap extension having a shape and configuration so as to be grasped by a user to pull said flap away from said first material layer.

* * * * *